US011484809B2

(12) United States Patent
Scholz et al.

(10) Patent No.: US 11,484,809 B2
(45) Date of Patent: Nov. 1, 2022

(54) HOLDING AND TAKE-OFF DEVICE FOR HYDROPNEUMATICALLY DRIVEN AIRCRAFT, IN PARTICULAR MODEL ROCKETS

(71) Applicant: SCHOLZ & GALLUS GMBH, Berlin (DE)

(72) Inventors: Friedemann Scholz, Berlin (DE); Andreas Gallus, Berlin (DE)

(73) Assignee: SCHOLZ & GALLUS GMBH, Berlin (DE)

( * ) Notice: Subject to any disclaimer, the term of this patent is extended or adjusted under 35 U.S.C. 154(b) by 0 days.

(21) Appl. No.: 17/058,750

(22) PCT Filed: Jun. 3, 2019

(86) PCT No.: PCT/EP2019/064315
§ 371 (c)(1),
(2) Date: Nov. 25, 2020

(87) PCT Pub. No.: WO2019/233936
PCT Pub. Date: Dec. 12, 2019

(65) Prior Publication Data

US 2021/0205723 A1 Jul. 8, 2021

(30) Foreign Application Priority Data

Jun. 6, 2018 (DE) ..... 102018113516.5
Jul. 9, 2018 (DE) ..... 102018116571.4

(51) Int. Cl.
*A63H 27/14* (2006.01)
*A63H 27/00* (2006.01)
*F41B 11/89* (2013.01)

(52) U.S. Cl.
CPC ..... *A63H 27/14* (2013.01); *A63H 27/005* (2013.01); *F41B 11/89* (2013.01)

(58) Field of Classification Search
CPC ..... A63H 27/005; A63H 27/06; A63H 27/14; A63H 17/006; F41B 11/89
(Continued)

(56) References Cited

U.S. PATENT DOCUMENTS 2,927,398 A * 3/1960 Kaye ..... A63H 27/005 446/212
3,025,633 A * 3/1962 Kaye ..... F41B 11/89 446/212
(Continued)

FOREIGN PATENT DOCUMENTS

DE 29517842 U1 3/1996 ..... A63H 27/00
GB 2145001 A 3/1985 ..... A63H 27/00
(Continued)

OTHER PUBLICATIONS

Notification Concerning Transmittal of International Preliminary Report on Patentability (Chapter I of the Patent Cooperation Treaty), in English, dated Dec. 17, 2020, which was issued by the International Bureau of WIPO in Applicant's corresponding international PCT application having Serial No. PCT/EP2019/064315, filed on Jun. 3, 2019.
(Continued)

*Primary Examiner* — Alexander R Niconovich
(74) *Attorney, Agent, or Firm* — Bodner & O'Rourke, LLP; Gerald T. Bodner; Christian P. Bodner

(57) ABSTRACT

A holding and starting device for hydro-pneumatically driven aircrafts composed of a base body carrying a flange that can be connected to it, the flange furthermore merging into a hollow cylinder portion receiving at least one sealing ring, latches pivotable about a shaft, and having a latch engagement means for a locking ring of the aircraft, and a release ring rotatably mounted on the base body, so that a release of the locking ring of the aircraft can take place. The latches have an actuating surface, which surface causes a
(Continued)

Figure 1:
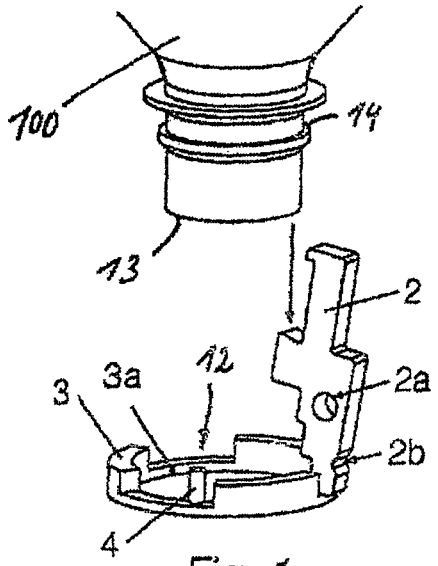

pivoting movement of the latches when a nozzle-like neck portion of the aircraft is put on. With or at a rotation of the release ring against pretension, stop ends of the latches move into a respective associated setoff or a respective associated recess, so that the latches release the locking ring for starting.

17 Claims, 5 Drawing Sheets

(58) Field of Classification Search
USPC ..... 446/212, 231, 429; 124/56, 57, 73
See application file for complete search history.

(56) References Cited

U.S. PATENT DOCUMENTS 3,148,478 A * 9/1964 Miller ..... A63H 17/006 446/435
3,962,818 A * 6/1976 Pippin, Jr. ..... A63H 27/005 446/212
5,188,557 A * 2/1993 Brown ..... A63H 27/14 446/212
5,197,452 A * 3/1993 Johnson ..... F41B 11/68 446/212
5,381,778 A * 1/1995 D'Andrade ..... F41B 11/89 124/75
5,415,153 A * 5/1995 Johnson ..... A63H 27/14 124/63
5,653,216 A * 8/1997 Johnson ..... A63H 27/14 124/75
5,839,940 A * 11/1998 Ensmenger ..... A63H 27/14 446/212
5,881,706 A * 3/1999 Carson ..... F41B 11/89 446/212
6,315,629 B1 * 11/2001 Jones ..... A63H 27/005 446/212
6,321,737 B1 * 11/2001 Johnson ..... F41B 11/641 124/75
6,347,623 B1 * 2/2002 Kownacki ..... A63H 17/006 124/56
6,460,531 B1 * 10/2002 Gourley ..... F41B 11/89 124/64
6,478,648 B1 * 11/2002 Applewhite ..... A63H 33/20 446/52
7,021,987 B1 * 4/2006 Lund ..... A63H 27/005 446/212
7,537,508 B1 * 5/2009 Picone ..... A63H 27/005 446/212
7,601,046 B2 * 10/2009 Chang ..... A63H 27/005 446/212
7,900,621 B2 * 3/2011 Al-Garni ..... F42B 4/24 124/56
8,627,812 B2 * 1/2014 Murdoch ..... F41B 11/72 124/56
9,086,251 B2 * 7/2015 Cummings ..... F41B 11/66
10,828,577 B2 * 11/2020 Golliher ..... A63H 30/02
2005/0009440 A1 * 1/2005 Foster ..... A63H 27/14 446/231
2012/0138037 A1 6/2012 Murdoch ..... 124/73

FOREIGN PATENT DOCUMENTS

KR 200269217 Y1 3/2002 ..... A63H 27/00
KR 200285559 Y1 8/2002 ..... A63H 27/14
KR 200336776 Y1 12/2003 ..... A63H 27/14
KR 200399386 Y1 10/2005 ..... A63H 27/14
KR 20080004969 U 10/2008 ..... A63H 27/14

OTHER PUBLICATIONS

English translation of the International Preliminary Report on Patentability (Chapter I of the Patent Cooperation Treaty), dated Dec. 8, 2020, which was issued by the International Bureau of WIPO in Applicant's corresponding international PCT application having Serial No. PCT/EP2019/064315, filed on Jun. 3, 2019.
Written Opinion of the International Searching Authority, in English, dated Sep. 10, 2019, which was issued by the International Bureau of WIPO in Applicant's corresponding international PCT application having Serial No. PCT/EP2019/064315, filed on Jun. 3, 2019.
International Search Report, in English, dated Sep. 10, 2019, which was issued by the International Bureau of WIPO in Applicant's corresponding international PCT application having Serial No. PCT/EP2019/064315, filed on Jun. 3, 2019.

* cited by examiner

>>open<<

>>closed<<

SECTION B-B
>>open<<

SECTION B-B
>>closed<<

SECTION A-A
>>open<<

SECTION A-A
>>closed<<

HOLDING AND TAKE-OFF DEVICE FOR HYDROPNEUMATICALLY DRIVEN AIRCRAFT, IN PARTICULAR MODEL ROCKETS

The invention relates to a holding and starting device for hydro-pneumatically driven aircrafts, in particular model rockets, composed of a base body carrying a flange that can be connected to it, the flange furthermore merging into a hollow cylinder portion receiving at least one sealing ring arranged at the outer circumference side, latches pivotable about a shaft, located on the flange and laterally encompassing the hollow cylinder portion, and having a latch engagement means for a locking ring of the aircraft, a release ring rotatably mounted on the base body relative to the longitudinal axis of the hollow cylinder portion and having recesses or setoffs for receiving stop ends of the respective latch, so that a release of the locking ring of the aircraft can take place, according to the preamble of claim 1.

Aircrafts in the form of water rockets have been part of the state of the art for some time. Water rockets are flying objects, in which a body partially filled with water is driven by means of the previously compressed air located above it. When the nozzle is released, the water exits by means of the compressed air from the rocket body at high velocity and accelerates the rocket body by a reaction effect. Water rockets may be used in educational lessons as a demonstration model for illustrating reaction force, but also in recreational activity.

Water rockets available on the market as model construction or toy articles may be pressurized with a manual pump, for example, and reach an altitude of several 10 meters.

As rocket bodies for the do-it-yourself construction of such flying objects, so-called PET beverage bottles are suited. The bursting pressure of such bottles is between 8 and 20 bar so that a sufficient energy accumulation is possible by pressure application.

Since the overpressure within the bottles used as rocket bodies, as well as the thrust and acceleration are considerable during starting, safe operation needs to be ensured.

Proposals for forming drive rockets driven by compressed air as toys already can be traced in protective rights from the 50s. By way of example, the German Utility Model 5546 or the Utility Model DE 295 17 842 U1 filed essentially later should be mentioned. The above-mentioned documents have in common that a relatively high air pressure is built up within a bottle body. In order to realize the pumping and starting process in a safe manner, a holding device was disclosed in the mentioned documents which has a bottom plate and from which holding brackets extend, which enter into operative connection with a tension lever and a trigger lever. A rocket filled with water is put onto a filling tube so that an outlet nozzle comes to lie on a sealing present there in the starting device. When a tension lever is actuated, the rocket body can be fixed. When the holding brackets connected to the tension lever are spread apart, a starting process may be executed.

From US 2005/009440 A1, a water rocket with an inflatable rocket body and a stand supporting the rocket body and which is further developed in this respect is already known. Moreover, a pump connected to the stand is provided which generates a fluid pressure to propel the rocket body. Furthermore, a releasing mechanism is present which enables the fluid pressure to propel the fuselage, i.e. the rocket body away from the stand. The releasing mechanism has claw-like holding means. In addition, a flange-like collar is provided receiving an end of the inflatable fuselage, wherein the collar has an O-ring for the purpose of sealing.

U.S. Pat. No. 8,627,812 B2 discloses a toy rocket launcher formed such as to pressurize a drinking bottle. A holding and releasing mechanism enables such a rocket to be started in a targeted manner. An internal release mechanism locks the bottle rocket in place and releases it with a slight pull on a string. A starting tube is provided there as well which has a thread adapter. As a sealing means, an O-ring is employed there as well, which is arranged around the circumference of the starting tube.

The rocket body according to U.S. Pat. No. 7,021,987 B1 is composed of plastic beverage bottles, wherein preferably water and compressed air are used as the propellant. The system there shows adjustable launch supports to vary the launch angle. In addition, the already known publication shows a holding and releasing mechanism which uses claw-like holding elements.

According to U.S. Pat. No. 5,188,557 A, toy rockets including cylindrical bodies are part of the state of the art, wherein the cited publication discloses a launcher device including a first conduit to receive a pneumatic air supply therethrough. Furthermore, a starting platform is shown having swivel elements so that the toy rocket can take off at various angles.

KR 20080004969 U discloses a starting device for a water rocket unit having angle variance.

A realization of a water rocket is likewise described in KR 200399386 Y1.

KR 200336776 Y1 shows a starting device for a water rocket having claw or hooks for fixing a bottle as a rocket body.

In GB 2 145 001 A1, the realization of toy rockets is disclosed, in which water ejected by compressed air is used as a propellant, and wherein a plastic beverage bottle is used.

A further state of the art in this respect is discussed in KR 200269217 Y1 and KR 200285559 Y1.

The generic document U.S. Pat. No. 6,315,629 B1 is based on a holding and starting device for hydro-pneumatically driven aircrafts, in particular model rockets. In this respect, as well, a compressed air/water drive assembly is employed. The triggering mechanism there comprises three pivotable latches arranged offset by 120°, which are fixed at a supporting block. In a first position, the latches hold the model rocket. In a second position, a displacement of the latches is performed such that the rocket is released for starting.

The depicted known solutions have in common that the holding and starting devices for hydro-pneumatically driven aircrafts, in particular model rockets, either are kept very simple, are mechanically unstable and therefore not operationally safe enough. On the other hand, solutions are disclosed in the state of the art which have an extraordinarily complicated and thus expensive construction. This, however, results in very high costs and a high susceptibility to failure which is not acceptable for gaming operations.

From the aforementioned, it is therefore a task of the invention to propose a further developed holding and starting device for hydro-pneumatically driven aircrafts, in particular model rockets, which is composed of few parts that are simple to manufacture and has a high safety when holding the model rocket during the pressure generation, which mechanically combines all functionalities and ultimately allows, even at an unsuccessful start of the rocket, pressure to be reduced in a riskless manner, so as to be able to begin a new start attempt.

The solution of the task of the invention is performed by a holding and starting device for hydro-pneumatically driven aircrafts, in particular model rockets, according to the feature combination in accordance with claim 1, the dependent claims comprising at least appropriate configurations and further developments.

Starting from the initially depicted state of the art, a holding and starting device for hydro-pneumatically driven aircrafts, in particular model rockets, is taken as a basis. The model rockets preferably are composed of a rocket body which can be formed by a commercial plastic beverage bottle.

It should be pointed out at this point that in a hydro-pneumatic drive for aircrafts, not only air pressure or gas can be used as an energy source, but a chemical pressure generation may also be applied, for example.

The holding and starting device has a base body carrying a flange that can be connected to it.

The flange merges into a hollow cylinder portion. Preferably, the flange and the hollow cylinder portion are composed of a monobloc component.

The hollow cylinder portion which can accommodate the bottleneck of the precedingly mentioned beverage bottle, has at least one sealing ring arranged at the outer circumference side, or a suitable sealing means.

At least one latch pivotable about a shaft is located on the flange so as to laterally encompass the hollow cylinder portion. Preferably, at least three latches are used.

The latches have a latch engagement means for a locking ring or a locking protrusion of the aircraft. Furthermore, a release ring rotatably mounted on the base body relative to the longitudinal axis of the hollow cylinder portion is present having recesses or setoffs for receiving stop ends of the respective latch, so that a release of the locking ring of the aircraft can take place.

According to the invention, the latches have an actuating surface between the point of rotation of the axis and the latch engagement means which surface causes a pivoting movement of the latches when a nozzle-like neck portion of the aircraft is put on. As a consequence, the respective latch engagement means engages behind the locking ring.

In this manner, the beverage bottle as a rocket body is fixed via the bottleneck and the shaping present there, here referred to as locking ring.

The release ring according to the invention is pretensioned in one of its rotational directions by means of an energy accumulator, wherein with a pivoting movement of the latches with their respective latch engagement means toward the locking protrusion, the stop ends of the latches are subjected to a positional change and hereby exit the respective recess or the respective setoff such that the release ring turns into a holding end position, and namely due to the pretension.

With or at a rotation of the release ring against the pretension, the stop ends of the latches move into the respective associated setoff or the respective associated recess, so that the latches release the locking ring for starting, wherein the latches are in this respect subjected to a pretension in the area between the point of rotation of the axis and the stop end toward the center or middle point of the release ring.

In a further development of the invention, a radially oriented actuating pin is arranged on the release ring.

The actuating pin, at one end, may have a projection, a bore or similar means for remote triggering. The remote triggering can be realized via a cord, a wire or similar pulling means.

The energy accumulator for generating the pretension of the release ring preferably is realized as a wrap spring.

Opposite the stop end, the respective latch may have a groove or notch for receiving a spring element, in particular an annular spring or an elastic O-ring in a guiding manner so as to apply the necessary pretension to the latches.

In a configuration of the invention, the hollow cylinder portion merges into a first lateral channel within the flange, wherein this channel is in connection with an overpressure valve.

In a further development of the invention, the hollow cylinder portion merges into a second lateral channel within the flange, wherein the second channel can be connected to a filling device, or wherein a filling device can be connected directly to the channel.

In one configuration of the invention, the hollow cylinder portion has a channel at the bottom side which is in connection with a safety valve that can be actuated by rotating the release ring, so as to achieve a targeted pressure relief upon a false start.

In one embodiment of the invention, the hollow cylinder portion merges into a third lateral channel within the flange, wherein the third channel is in or can be brought into connection with a pressure accumulator.

The release ring can be actuated manually via the actuating pin and a pull cord but also electromagnetically or electromechanically.

The hollow cylinder portion can be formed as a starting tube or can accommodate such a starting tube.

Furthermore, in a further development of the invention, the hollow cylinder portion is exchangeable for adapting to various aircrafts or flying objects.

The latches may likewise be designed to be exchangeable for adapting to various flying objects.

The holding and starting device can be connected to a starting plate or a starting stand or similar means so as to ensure a safe position of the flying object prior to and during the starting process.

In one configuration of the invention, the hollow cylinder portion may be in connection with a pressure measuring device and comprise a fourth channel in this respect.

In one embodiment of the invention, the release ring is in connection with a stop for limiting its rotational movement, so that conditions that are always reproducible are present with and after the actuation of the release ring.

The invention will be explained in more detail below on the basis of an exemplary embodiment and with reference to Figures.

Figure 7:
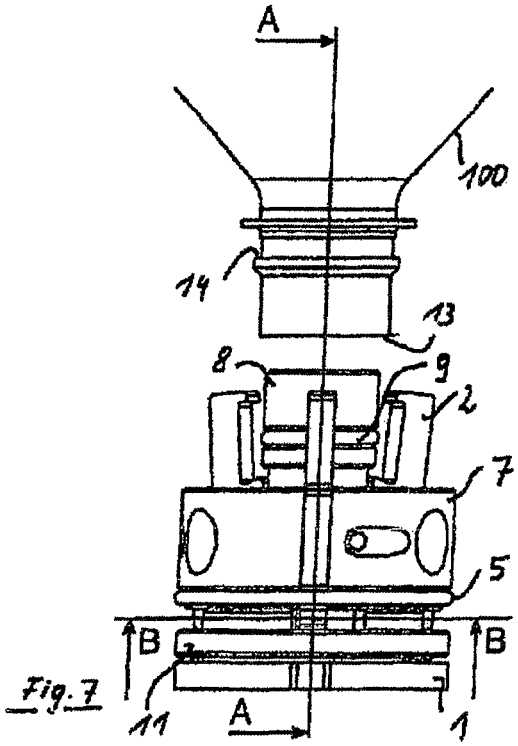
Figure 9:
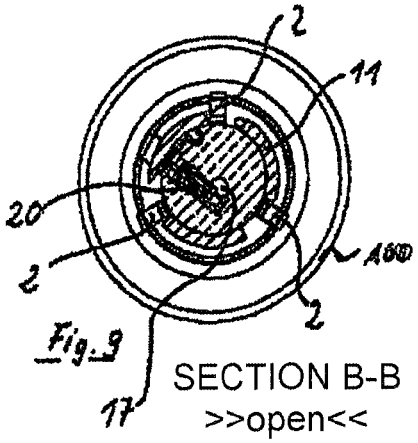
Figure 10:
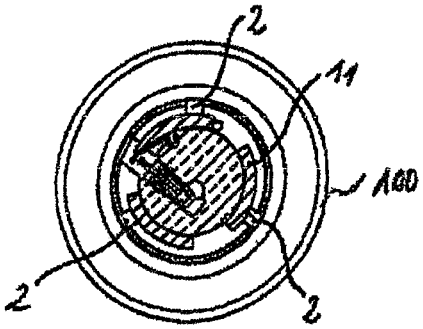
Figure 8:
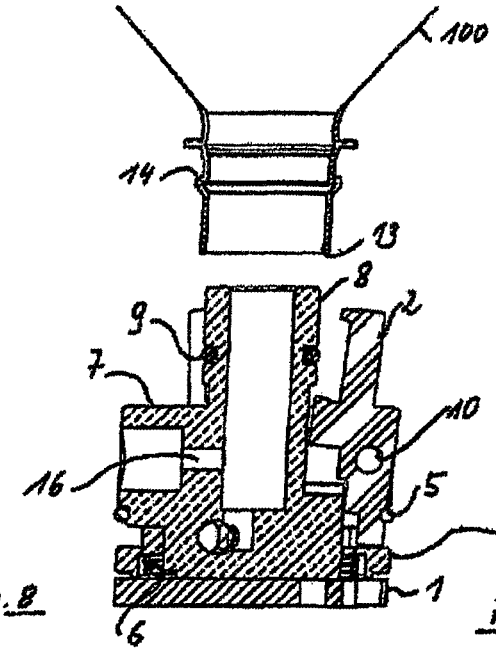
Figure 11:
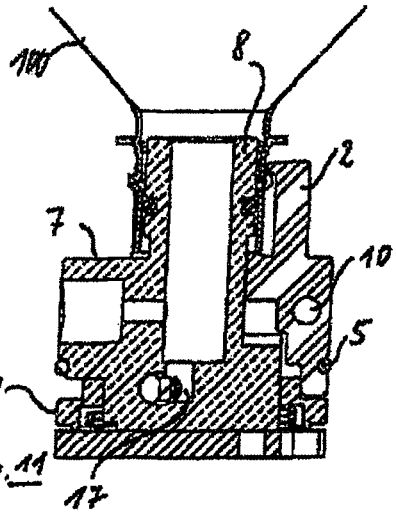
Figure 12:
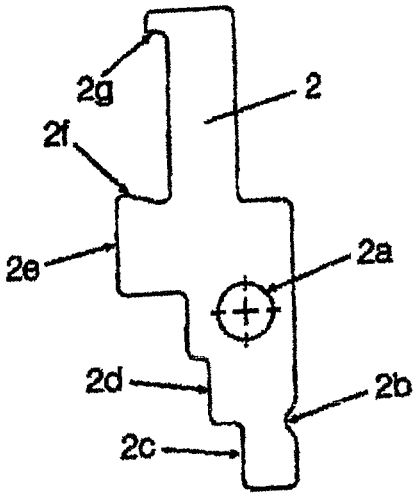
Figure 13:
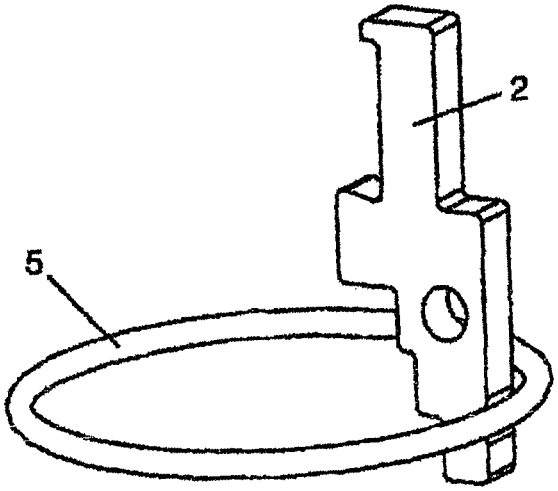
Figure 14:
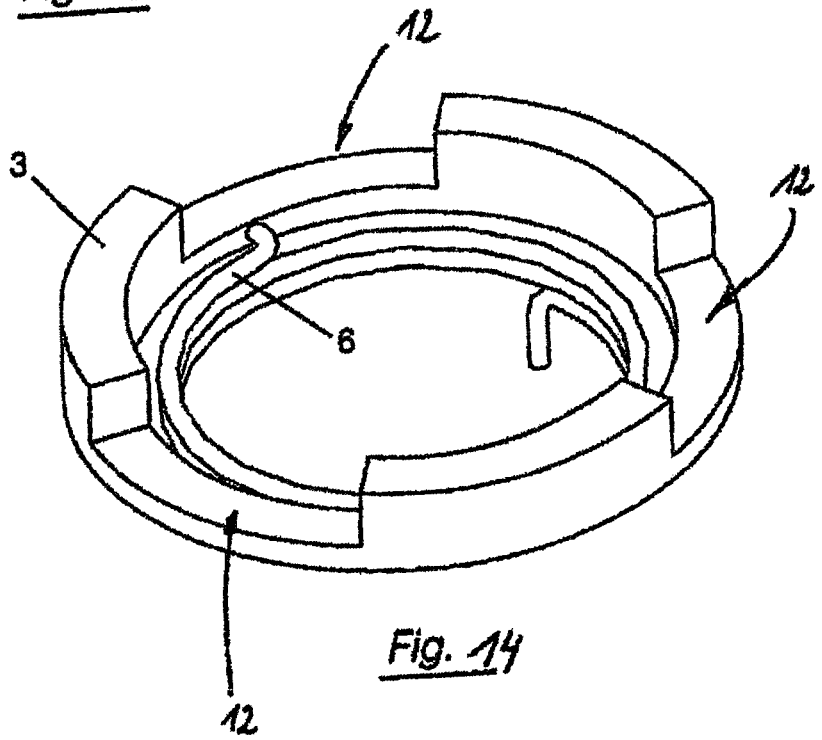
Figure 15:
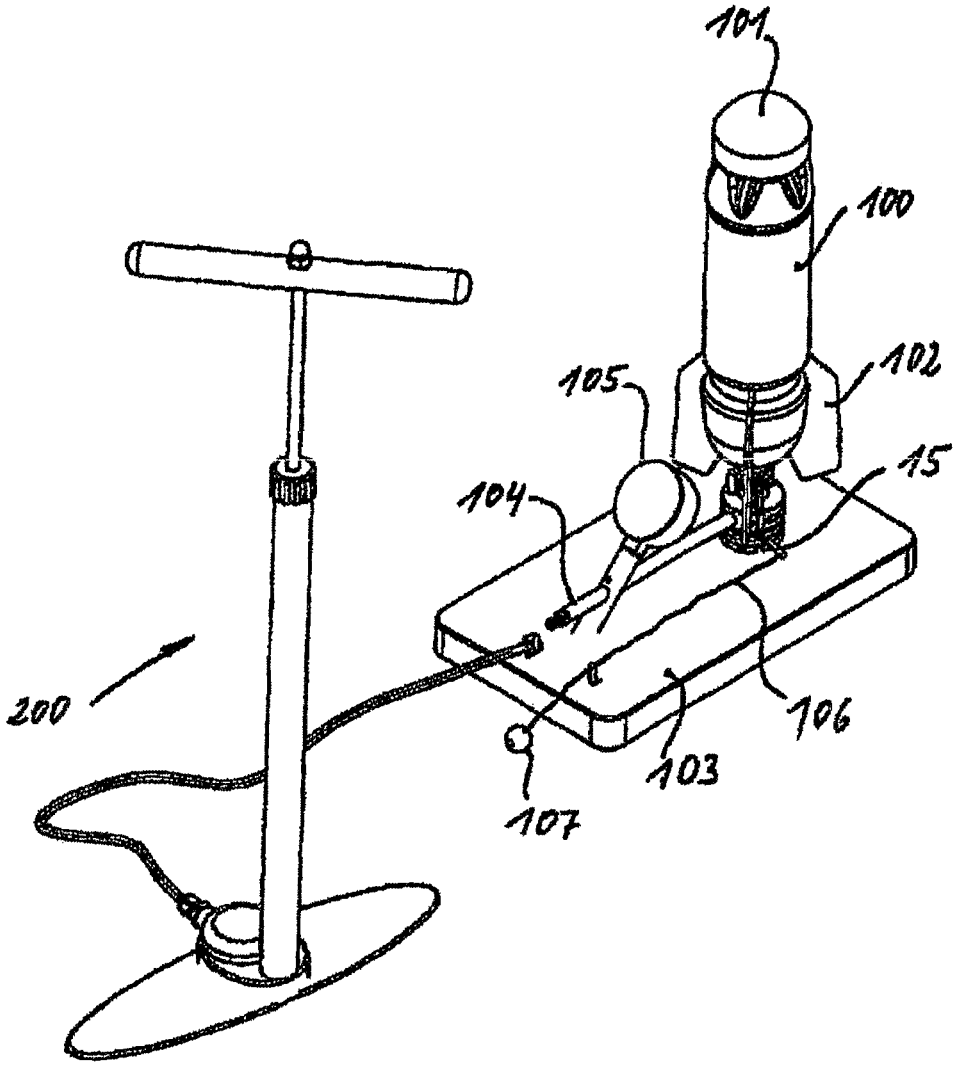
Figure 16:
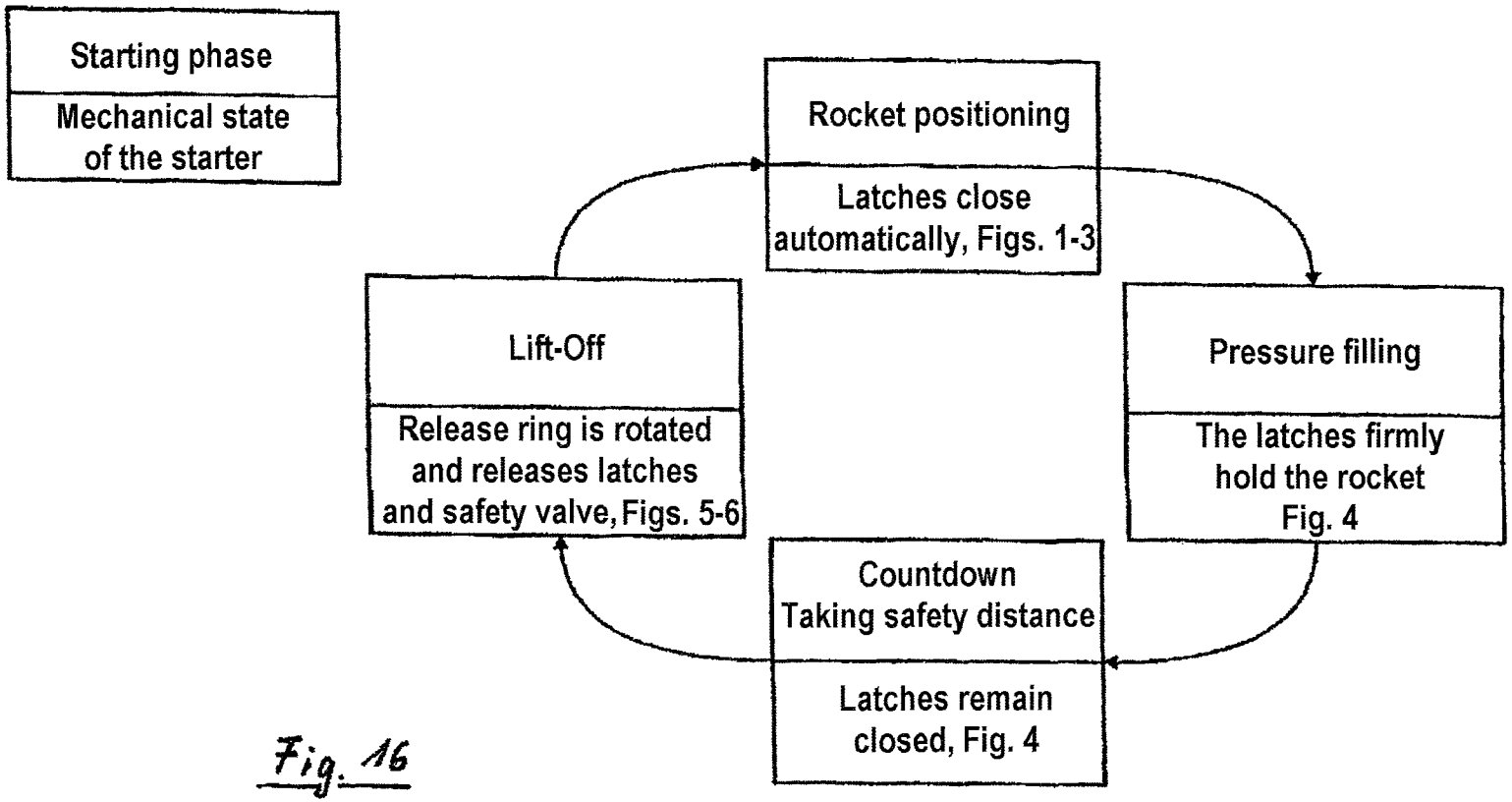

Shown are in:

FIGS. 1 to 6 a sequence as a schematic sketch illustrating the process of locking and releasing in the interaction of a bottle as a flying object, a latch, a release ring and a stop;

FIG. 7 a detail representation of the holding and starting device in a lateral view with latches being spread apart, and a bottle body with a bottleneck, prior to be pushed onto the hollow cylinder portion;

FIG. 8 a representation similar to that according to FIG. 7 along line A-A as a longitudinal section;

FIGS. 9 and 10 section representations along line B-B, once in the non-locked, i.e. open state, and in the locked, i.e. closed state;

FIG. 11 a longitudinal section representation along line A-A in the closed state, i.e. the flying object being locked;

FIG. 12 a detail representation of a latch according to the invention as an essential component of the holding and starting device;

FIG. 13 a further detail representation in a perspective view, comprising an exemplary latch together with an O-ring for generating a pretension acting upon the latch;

FIG. 14 a representation of a release ring having setoffs or recesses, and an inserted wrap spring for generating a pretension in a preferential rotational direction of the release ring;

FIG. 15 a representation of an exemplary entire arrangement, comprising a holding and starting device mounted onto a starting board with a pressure measuring device, a connectable hand pump for pressure generation, as well as a pull cord with a pull button for remotely actuating the release ring; and FIG. 16 a flow chart of an exemplary model rocket start using the device according to the invention.

The device according to the invention will now be explained with reference to the above-mentioned Figures and an exemplary embodiment resulting therefrom.

As a flying object for a model rocket, a commercial, for example, PET beverage bottle 100 is used.

In their bottleneck area 13, such beverage bottles 100, on the one hand, have a thread, and, on the other, at least one circumferential locking ring 14.

The respective bottle 100 that is partially filled with water, is slipped upside down onto the holding and starting device according to the invention and insofar is pushed with its bottleneck 13 onto the hollow cylinder portion 8 that is adapted in its diameter.

An O-rung 9 provides in this case the necessary sealing so as to avoid water from exiting during pressure application of the flying object.

The hollow cylinder portion 8 is an integral component of a flange 7. By way of example, both the flange 7 and the hollow cylinder portion 8 may be manufactured in one piece as a turned part, or may be fabricated, for example, by plastic injection molding.

Embedded into the flange 7 and rotatably mounted there via a shaft 10 or 2*a*, at least one latch 2, preferably three mutually offset pivotable latches 2 is or are present.

The latches 2 each have a latch engagement means 2*g* (see FIG. 12) for the locking ring 14 of the beverage bottle 100, which serves as a rocket body as has been explained.

On a base body 1, not only the flange 7 with the hollow cylinder 8 is fixed, but a rotatably mounted release ring 3; 11 is furthermore present which is under the pretension of a spring 6.

As shown in FIG. 14, the release ring 3 has recesses or setoffs 12. These recesses or setoffs 12 serve for receiving stop ends 2*c* (see FIG. 12) of the respective latch 2, so that a release of the locking ring 14 of the rocket body 100 may be performed.

According to the representation in accordance with FIGS. 7 and 8, the neck of the rocket body 100, respectively the beverage bottle, is not yet pushed onto the hollow cylinder portion 8.

With the execution of such a push-on movement (see also the procedure in accordance with FIGS. 1 to 6), a lower edge of the bottleneck gets into contact with the respective actuating surface 2*f* of the respective latch 2.

Hereby, the respective latch performs a pivoting movement about its shaft 10; 2*a*.

Due to this pivoting movement, the latch engagement means 2*g* gets into engagement with the locking ring 14 such that the latch engagement means engages behind the locking ring and thus secures the rocket body 100 to the holding and starting device.

Figure 4:
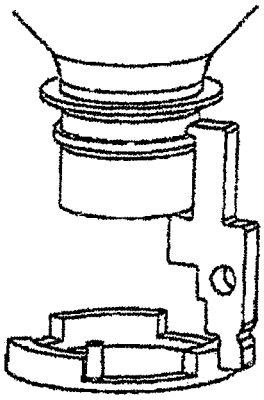

Due to the fact that the release ring 3 is under pretension using the spring 6, a rotation takes place by the release of the corresponding recess or setoff 12 due to the pivoting movement of the respective latch. The rotational movement of the release ring 3 is performed in this case such that a final position, as represented in FIG. 4, is reached as a result.

The rotational movement of the release ring 3 is limited by means of a stop 4. The depth of the corresponding recess 12 is selected such that a release ring web 3*a* remains and the pivoting movement of the latch 2 is unimpeded.

As can be recognized in FIGS. 8, 9, 10 and 11, a channel 17 is located in the bottom area of the hollow cylinder portion 8, which channel receives a safety valve 20. When the starting process is released upon rotation of the release ring against its pretension direction, the safety valve can be opened, so that, when no start has taken place, i.e. when a disengagement of the rocket body 100 from the starting device has not taken place, the present pressure dissipates to the outside via the channel 17 and the opened safety valve. In this respect, the opening side of the valve 20 is in connection with an outlet in the flange 7.

The latches 2 hence have an actuating surface 2*f* between the point of rotation of the shaft 2*a* or 10, and the latch engagement means 2*g* at the upper end of the latch. This actuating surface 2*f* may be realized as a wedge surface/sloping surface. When the flying object 100 is put or pressed in place, the holding portion 13 gets into contact with the corresponding actuating surfaces 2*f* of the respective latch 2. This causes a pivoting movement of the latches with the result that the respective latch engagement means 2*g* engages behind the upper edge of the locking ring 14 (see, for example, FIGS. 2 and 3).

Due to the fact that the release ring 3 is pretensioned in one of its rotational directions by means of the energy accumulator 6, and due to the fact that with the pivoting movement of the latches 2 with their latch engagement means 2*g* toward the locking protrusion 14, the stop ends 2*c* of the latches 2 are subjected to a positional change, the respective recesses or setoffs 12 are exited such that the release ring 3; 11 turns into the holding end position (see FIG. 4).

Figure 5:
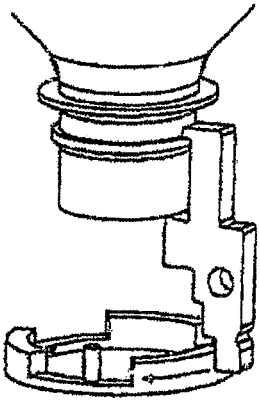
Figure 6:
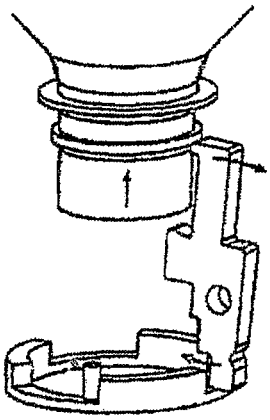

When the release ring 3; 11 is now twisted against the pretension direction (see arrow representations according to FIG. 5), the stop ends 2*c* of the latches move into the respective recess or setoff 12 so that the latches 2 release the locking ring 14 to start (see FIGS. 5 and 6).

In this respect, the latches 2 are subjected to a pretension in the area between the point of rotation of the shaft 2*a* and the stop end 2*c*, i.e. the lower end of the latches 2, toward the center or the middle point of the release ring 3; 11.

The pretension is generated here by means of an elastic ring 5 which can be guided within a corresponding notch 2*b* of the latch 2 (see FIG. 13). In this respect, the flange, as well, has a groove at its outer circumference which guides the pretension element 5 (see sectional representations according to FIGS. 8 and 11).

A model rocket prepared for starting according to the view in accordance with FIG. 15, in turn takes a flying object 100 in the form of a modified beverage bottle as a basis. The modification here is performed such that, at the head side, a dome 101 acting as an impact attenuator, and, at the nozzle or drive side, a plurality of tail units 102 are attached.

The holding and starting device is located on a board-like base 103.

The board-like base 103 receives a compressed air filling tube 104, and in one configuration, a pressure measuring device 105.

In the representation according to FIG. 15, an actuation of the release ring is performed by using an actuating pin 15.

The actuating pin 15 is in connection with a pull cord 106. The end of the pull cord 106 remote from the actuating pin 15 has a pull button 107.

By pulling the pull button 107, the start may be enabled from a safe distance.

A commercial hand pump 200 serves for the necessary generation of compressed air by connecting the pump to a valve end of the tube 104, which valve end had been modified in this respect.

The starting process is summarized by means of the flow chart according to FIG. 16.

Figure 2:
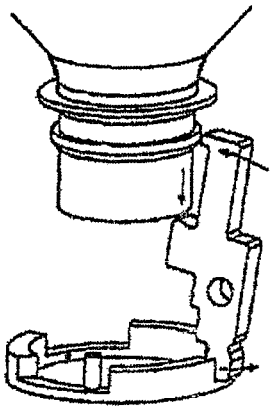
Figure 3:
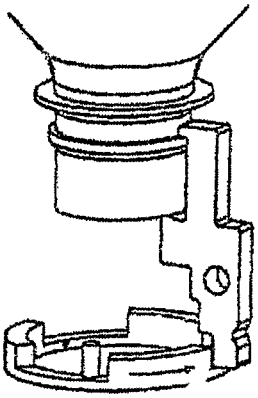

As shown in FIGS. 1 to 3 with reference to elements that are essential in this respect, the rocket body in the form of a beverage bottle 100 is first put on. In doing so, the latches close automatically. Thereafter, a pressure filling is realized while using the hand pump 200. During this process, the latches firmly hold the rocket body 100 (FIG. 4). During a countdown for taking the safety distance, the latches still remain locked and are released with an actuation of the element 107 while using the release ring. This process is illustrated in FIGS. 5 and 6.

If the flying objects 100 gets jammed on the hollow cylinder portion 8, this will lead to an aborted take-off and an automatic pressure relief.

After the rocket's lift-off, a new rocket positioning and a corresponding start preparation may be performed.

According to the exemplary embodiment, the safety valve 20 is opened prior to the latches being released. Since the release ring rotates completely and rapidly up to its stop, only a slight amount of pressurized liquid gets lost by this opening of the safety valve 20. Due to the different cross-sections relative to the relationship of the nozzle-like opening on the flying object, and the dimensions in terms of the safety valve, there is no disadvantage for the actual start process.

For controlling the release process relative to the safety valve 20, the release ring may have a corresponding sloping surface or a stepped surface. By means of such a sloping surface, the rotational movement of the ring can be converted into a translational movement.

In order to prevent a lateral pressure on the tappet of the safety valve known per se, a protective plate or similar means may be provided.

In the exemplary embodiment explained above, and in the Figures, it is assumed that the release ring is located below the axes of rotation of the respective latches 2. Alternatively, there is the general possibility for the release ring to be arranged even above the axes of rotation of the latches.

In a further development of the invention, there is the possibility for a mechanical or electrical switch to be arranged together with a corresponding contact in the area of the latches or the release ring, in order to trigger a time measuring device or another signalizing device with the release of the start process.

In a configuration of the invention, there is the possibility for the closed position of the ring to be modified by a spring-loaded ball in the form of a catch. This results in a noticeable pressure point or a rotation of the release ring toward the corresponding stop when being released, since a breakaway torque needs to be overcome relative to the spring-loaded ball acting as a catch.

The invention claimed is:

1. A holding and starting device for hydro-pneumatically driven aircraft, composed of a base body (1) carrying a flange (7) that can be connected to it, the flange (7) further-more merging into a hollow cylinder portion (8) receiving at least one sealing ring (9) arranged at an outer circumference side, latches (2) pivotable about a shaft (10; 2*a*), located on the flange and laterally encompassing the hollow cylinder portion (8), and having a latch engagement means (2*g*) for a locking ring (14) of the aircraft (100), a release ring (3; 11) rotatably mounted on the base body (1) relative to a longitudinal axis of the hollow cylinder portion (8) and having recesses or setoffs (12) for receiving stop ends (2*c*) of the respective latch (2), so that a release of the locking ring (14) of the aircraft (100) can take place, the release ring (3; 11) being rotatable in one or more rotational directions, characterized in that the latches (2) have an actuating surface (2*f*) between a point of rotation of the shaft (2*a*) and the latch engagement means (2*g*) which surface causes a pivoting movement of the latches (2) when a nozzle-like neck portion (13) of the aircraft (100) is put on, with a consequence, that the respective latch engagement means (2*g*) engages behind the locking ring (14), furthermore the release ring (3; 11) is pretensioned in one of its rotational directions by means of an energy accumulator (6), wherein with a pivoting movement of the latches (2) with their respective latch engagement means (2*g*) toward the locking ring, the stop ends (2*c*) of the latches (2) are subjected to a positional change and exit the respective recess or the respective setoff (12) such that the release ring (3; 11) turns into a holding end position, and with or at a rotation of the release ring (3; 11) against the pretension, the stop ends (2*c*) of the latches (2) move into the respective associated setoff or the respective associated recess (12), so that the latches (2) release the locking ring (14) for starting, wherein the latches (2) are in this respect subjected to a pretension in an area between the point of rotation of the shaft (2*a*) and the stop end (2*c*) toward a center or middle point of the release ring (3; 11).

2. The device according to claim 1, characterized in that a radially oriented actuating pin (15) is arranged on the release ring (3; 11).

3. The device according to claim 1, characterized in that the energy accumulator (6) is a warp spring.

4. The device according to claim 1, characterized in that opposite the stop end (2*c*), the respective latch (2) has a groove or notch (2*b*) for receiving a spring element (5) in a guiding manner.

5. The device according to claim 4, wherein the spring element (5) is an annular spring or an elastic O-ring.

6. The device according to claim 1, characterized in that the hollow cylinder portion (8) merges into a first lateral channel (16) within the flange (7), wherein this channel (16) is in connection with an overpressure valve.

7. The device according to claim 1, characterized in that the hollow cylinder portion (8) merges into a second lateral channel within the flange, wherein the second channel can be connected to a filling device.

8. The device according to claim 1, characterized in that the hollow cylinder portion (8) has a bottom side and a channel (17) at the bottom side which is in connection with a safety valve (20) that can be actuated by rotating the release ring (3; 11).

9. The device according to claim 1,
characterized in that
the hollow cylinder portion (8) merges into a third lateral channel within the flange (7), wherein the third channel is in connection or can be brought into connection with a pressure accumulator.

10. The device according to claim 1,
characterized in that
the release ring (3; 11) can be actuated electromechanically or electromagnetically.

11. The device according to claim 1,
characterized in that
the hollow cylinder portion (8) is formed as a starting tube or accommodates a separate starting tube.

12. The device according to claim 1,
characterized in that
the hollow cylinder portion (8) is exchangeable for adapting to various aircraft (100).

13. The device according to claim 1,
characterized in that
the latches are exchangeable for adapting to various aircraft (100).

14. The device according to claim 1,
characterized in that
the base body (1) can be connected to a starting plate (103) or a starting stand.

15. The device according to claim 1,
characterized in that
the hollow cylinder portion is in connection with a pressure measuring device (105).

16. The device according to claim 1,
characterized in that
the release ring (3) is in connection with a stop (4) for limiting its rotational movement.

17. The device according to claim 1, wherein the hydropneumatically driven aircraft is a model rocket.

* * * * *